US006588221B1

(12) United States Patent
Gregory

(10) Patent No.: US 6,588,221 B1
(45) Date of Patent: Jul. 8, 2003

(54) REFRIGERATION SYSTEM WITH DEDICATED COMPRESSOR FOR HOT GAS DEFROST

(75) Inventor: Charles Gregory, Burlington (CA)

(73) Assignee: Super S.E.E.R Systems Inc., Burlington (CA)

( * ) Notice: Subject to any disclaimer, the term of this patent is extended or adjusted under 35 U.S.C. 154(b) by 0 days.

(21) Appl. No.: 10/277,900

(22) Filed: Oct. 23, 2002

(51) Int. Cl.[7] ..... F25B 47/02
(52) U.S. Cl. ..... 62/81; 62/278; 62/510
(58) Field of Search ..... 62/278, 277, 196.1, 62/196.4, 81, 510, 151, 152

(56) References Cited

U.S. PATENT DOCUMENTS 2,841,962 A * 7/1958 Richards ..... 62/278 X
3,234,754 A * 2/1966 Quick ..... 62/278 X
3,645,109 A * 2/1972 Quick ..... 62/510 X
3,869,874 A * 3/1975 Ditzler ..... 62/277 X

* cited by examiner

*Primary Examiner*—Harry B. Tanner
(74) *Attorney, Agent, or Firm*—Robert F. Delbridge

(57) ABSTRACT

A method of defrosting a refrigeration system having a main compressor connected by a main hot gas discharge line to a condenser, the condenser being connected by a main liquid line to thermal expansion valves and subsequent cooling coils, each thermal expansion valve and cooling coil being in parallel connection with the other thermal expansion valves and cooling coils, and each cooling coil being connected by a suction line to the main compressor, the defrosting method includes passing hot gas from the main hot gas discharge line through a selected cooling coil to defrost same, compressing cooled hot gas which has passed through the cooling coil by means of a separate dedicated defrost compressor, and returning the compressed hot gas to the main hot gas discharge line.

7 Claims, 2 Drawing Sheets

REFRIGERATION SYSTEM WITH DEDICATED COMPRESSOR FOR HOT GAS DEFROST

FIELD OF INVENTION

This invention relates to refrigeration systems with hot gas defrost.

BACKGROUND OF INVENTION

Hot gas defrost is very effective and is especially useful with refrigeration systems in merchandising cabinets (also known as cases) in supermarkets where many food products have to be displayed in refrigerated cases. Many modem supermarkets are much larger than in the past, with the result that known hot gas defrost systems are somewhat expensive to install and operate and also contribute to product deterioration.

It is therefore an object of the present invention to provide a hot gas defrost system which is less expensive to install and operate than known systems and which enhance product storage.

SUMMARY OF INVENTION

According to the invention, a hot gas defrost system is provided with a dedicated defroster compressor, that is to say a compressor which functions in the defrost circuit only and is additional to the compressor or compressors which are provided in the main refrigeration system. The invention enables defrosting to be effected without affecting the normal operating pressures of the main compressor or comressors.

The present invention accordingly provides a method of defrosting a refrigeration system having a main compressor connected by a main hot gas discharge line to a condenser, said condenser being connected by a main liquid line to thermal expansion valves and subsequent cooling coils, each thermal expansion valve and cooling coil being in parallel connection with the other thermal expansion valves and cooling coils, each cooling coil being connected by a suction line to main compressor, said defrosting method including passing hot gas from the main hot gas discharge line through a selected cooling coil to defrost same, compressing cooled hot gas which has passed through the cooling coil by means of a separate dedicated defrost compressor, and returning the compressed hot gas to the main hot gas discharge line.

The hot defrost gas may also be passed through the main liquid line to flush out liquid refrigerant therefrom. Also, the cooled defrost gas may be heated by heat exchange with hot gas from the main hot gas discharge line.

The present invention also provides a refrigeration system with a hot gas defrost circuit, said refrigeration system including a main compressor connected by a main hot gas discharge line to a condenser, said condenser being connected by a main liquid line to thermal expansion valves and subsequent cooling coils, each thermal expansion valve and cooling coil being in parallel connection with the other thermal expansion valves and cooling coils, each cooling coil being connected by a suction line to said main compressor, each cooling coil being connected by a suction line to said compressor, and said hot gas defrosting circuit including a defrost hot gas supply line for supplying defrost hot gas from the main hot gas discharge line to a selected cooling coil, a defrost suction line to receive cooled hot gas from the cooling coil, a dedicated defroster compressor connected to the defrost suction line for compressing said cooled hot gas, and a defrost compressor output line for passing compressed hot defrost gas to said main hot gas discharge line.

The defrost hot gas supply line may also supply defrost hot gas to the main liquid line to flush out liquid refrigerant therefrom. Also, the system may also include a vaporizer through which the defrost hot gas and the cooled defrost hot gas pass in heat exchange relationship.

DESCRIPTION OF THE DRAWINGS

One embodiment of the invention will now be described, by way of example, with reference to the accompanying drawings, of which.

DESCRIPTION OF PREFERRED EMBODIMENT

Figure 1:
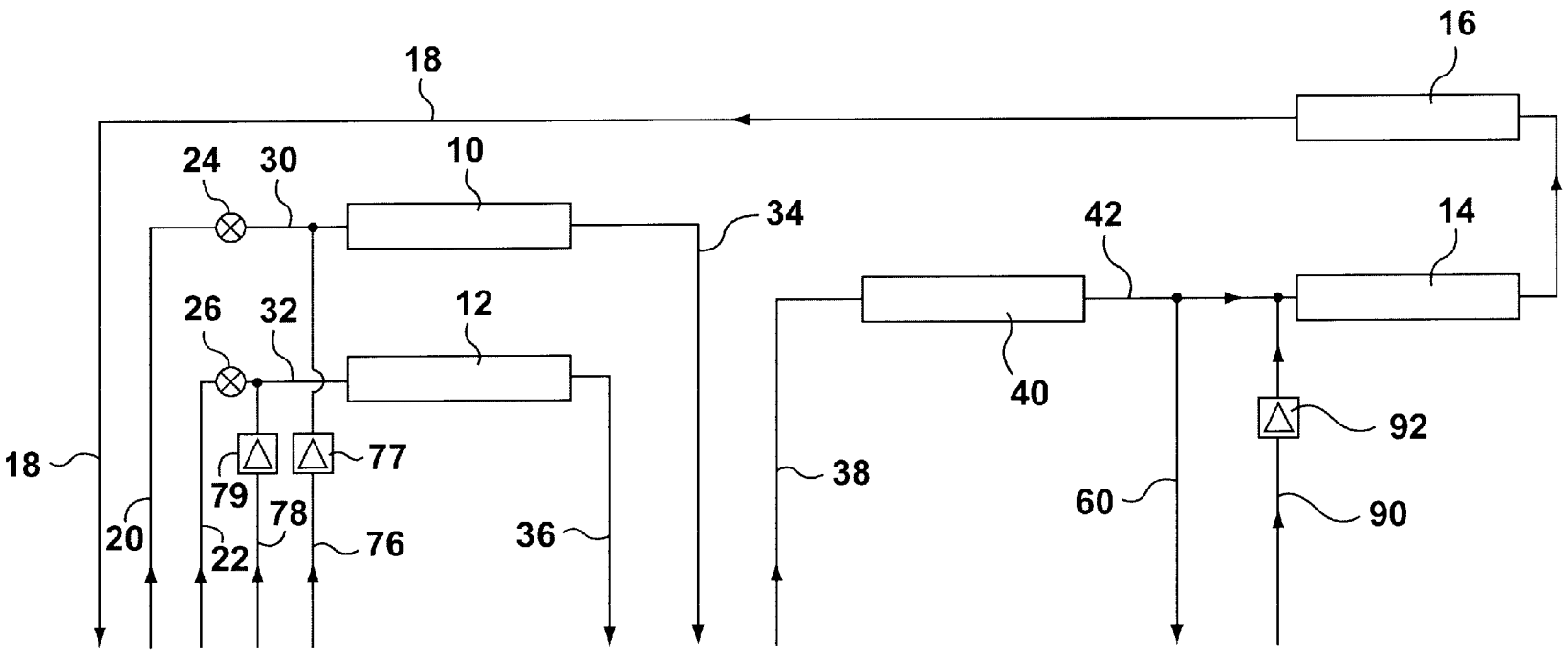
FIG. 1 is a circuit diagram primarily showing a conventional refrigeration system adapted for connection to a hot gas defrost system in accordance with one embodiment of the invention.

Referring to the accompanying drawings and first to FIG. 1, merchandising cases in a supermarket have refrigeration systems with conventional cooling coils 10, 12. For simplicity, only two cooling coils 10, 12 are shown, it being understood that there may be more. It will be appreciated by a person skilled in the art that fans (not shown) will be provided to pass circulated air in the merchandising cases over the cooling coils 10,12. In the normal refrigeration mode, liquid refrigerant from a conventional condenser 14 and reservoir 16 passes along a main liquid line 18 and, after passing by a portion of a hot gas defrost circuit as will be described in more detail later, then passes along liquid lines 20, 22 to thermal expansion (TX) valves 24, 26 respectively. The output cold liquid from the TX valves 24, 26 then passes to cooling coils 10, 12 along lines 30,32 respectively, the TX valve 24 and cooling coil 10 thus being in parallel connection with TX valve 26 and cooling coil 12 and also of course in parallel connection with any further TX valves and cooling coils.

After leaving the cooling coils 10, 12, the resultant gaseous refrigerant passes along suction lines 34, 36 and, after passing by a portion of the defrost circuit to be described, passes into main suction line 38 and flows to a conventional refrigeration system compressor 40. Hot gas from the compressor 40 passes along hot gas discharge line 42 to condenser 14.

A person skilled in the art will recognize that, apart from the connections to the defrost circuit to be described, the refrigeration system described above is conventional.

Figure 2:
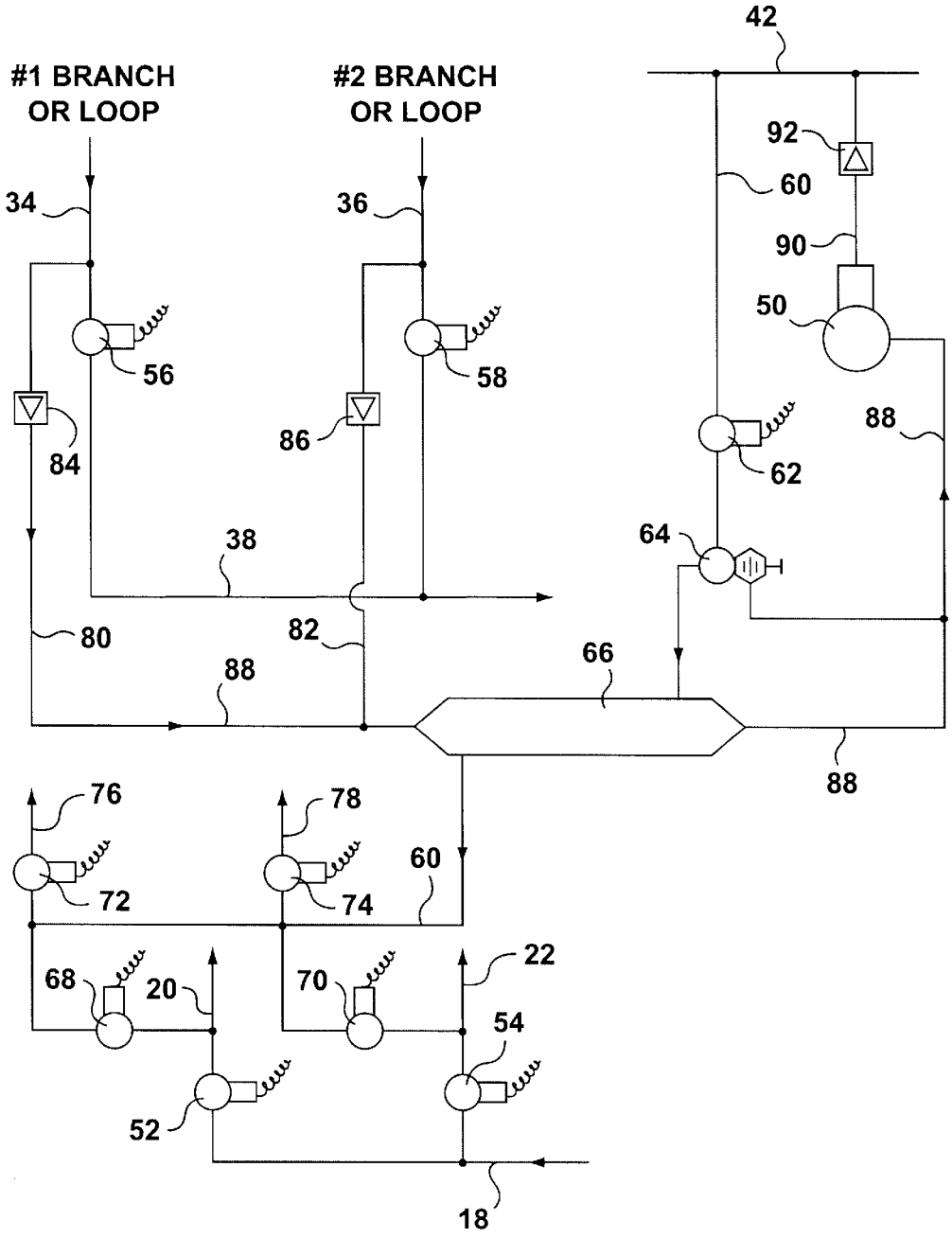
FIG. 2 is a circuit diagram of a hot gas defrost system in accordance with one embodiment of the invention.

A hot gas defrost system in accordance with one embodiment of the invention will now be described with particular reference to FIG. 2. The primary feature of the invention is that hot gas from the compressor 40 which is used to defrost the cooling coils 10, 12 is not thereafter returned to the compressor 40 as is conventional but is passed to a dedicated defrost compressor 50 in the defrost circuit and then to condenser 14 in the main refrigeration system.

During normal operation of the refrigeration system, liquid refrigerant in main liquid line 18 passes through normally open electrically-operated solenoid valves 52, 54 to liquid lines 20, 22, TX valves 24, 26 and cooling coils 10, 12. Gaseous refrigerant from cooling coils 10, 12 pass along suction lines 34, 36 through normally open electrically-operated solenoid valves 56, 58 to main suction line 38 and main compressor 40.

A hot gas supply line 60 extends from main hot gas discharge line 42 and passes through a normally closed electrically-operated solenoid valve 62 and a pressure-controlled valve 64 (to be explained in more detail later) before passing through a vaporizer 66. The hot gas supply line 60 is then connected through normally closed electrically-operated solenoid valves 68, 70 to liquid lines 20, 22 and TX valves 24,26. The hot gas supply line 60 is also connected through normally closed electrically-operated solenoid valves 72, 74 to lines 76, 78 which lead to lines 30, 32 and hence to cooling coils 10, 12 downstream of the respective TX valves 24, 26.

Upstream of suction line solenoid valves 56, 58, defrost suction lines 80, 82 extend from suction lines 34, 36 respectively through check valves 84, 86 to defrost suction line 88. Defrost suction line 88 passe through vaporizer 66 and leads to dedicated defrost compressor 50. A hot gas discharge line 90 leads from compressor 50 through a check valve 92 to main hot gas discharge line 42.

In accordance with this embodiment of the invention, defrost actuation for the cooling coil 10 causes liquid line solenoid valve 52 to be closed. At the same time, hot gas supply line solenoid valves 62 and 68 are opened. Hot gas from main hot gas discharge line 42 then flows along hot gas supply line 60 through the vaporizer 66 and solenoid valve 68 to line 20 and then to the TX valve 24 and cooling coil 10. This stage of the defrost cycle flushes liquid refrigerant from liquid line 20 and TX valve 24.

When liquid refrigerant has been flushed out from liquid line 20 and TX valve 24, the relevant cooling coil fan (not shown) is stopped and the hot gas supply solenoid valve 72 is opened to cause hot gas to flow directly to the cooling coil 10 through line 76 which includes check valve 77, by-passing the TX valve 24. At the same time, suction line solenoid valve 56 is closed, thereby diverting refrigerant leaving the cooling coil 10 from main suction line 38 into defrost suction lines 80 and 88 through check valve 84.

Thus, the cooled defrost gas which has passed through cooling coil 10 is somewhat heated in the vaporizer 66 by the incoming defrost hot gas before being compressed by the dedicated defrost compressor 50 and returned to the main hot gas discharge line 42 through check valve 92. Such heat exchange also serves to cool incoming hot gas somewhat as it passes through the vaporizer 66. Incoming hot gas is controlled by pressure-controlled valve 54 in accordance with pressure in the defrost suction line 89 upstream of the defrost compressor 50, a pressure sensing line 94 being provided for this purpose.

After a predetermined time, the defrost cycle for cooling coil 10 is de-activated and the various valves are returned to their normal refrigeration cycle settings. A similar procedure occurs if cooling coil 12 or another cooling coil (not shown) in the circuit is to be defrosted.

While cooling coil 10 is being defrosted, the other cooling coils (namely cooling coil 12 and others as explained above) remain connected in the main circuit such that refrigerant therefrom proceeds along the main suction line 38 to the main compressor 40. Refrigerant in hot gas form used to defrost one of the cooling coils is compressed by dedicated defrost compressor 50 and returned to the main hot gas discharge line 42 without affecting the normal operating pressures of the main compressor 40.

The economic and other advantages of the present invention will now be clear to a person skilled in the art from the foregoing description of a preferred embodiment. Other embodiments could also now be readily apparent, scope of the invention being defined in the appended claims.

What is claimed is:

1. A method of defrosting a refrigeration system having a main compressor connected by a main hot gas discharge line to a condenser, said condenser being connected by a main liquid line to thermal expansion valves and subsequent cooling coils, each thermal expansion valve and cooling coil being in parallel connection with the other thermal expansion valves and cooling coils, each cooling coil being connected by a suction line to the main compressor, said defrosting method including passing hot gas from the main hot gas discharge line through a selected cooling coil to defrost same, compressing cooled hot gas which has passed through the cooling coil by means of a separate dedicated defrost compressor, and returning the compressed hot gas to the main hot gas discharge line.

2. A method according to claim 1 including also passing said hot gas through the main liquid line to flush out liquid refrigerant therefrom.

3. A method according to claim 1 including heating said cooled hot gas by heat exchange with said hot gas from the main hot gas discharge line.

4. A refrigeration system with a hot gas defrost circuit, said refrigeration system including a main compressor connected by a main hot gas discharge line to a condenser, said condenser being connected by a main liquid line to thermal expansion valves and subsequent cooling coils, each thermal expansion valve and cooling coil being in parallel connection with the other thermal expansion valves and cooling coils, each cooling coil being connected by a suction line to said main compressor, each cooling coil being connected by a suction line to said compressor, and said hot gas defrosting circuit including:

a defrost hot gas supply line for supplying defrost hot gas from the main hot gas discharge line to a selected cooling coil, a defrost suction line to receive cooled hot gas from the cooling coil, a dedicated defroster compressor connected to the defrost suction line for compressing said cooled hot gas, and a defrost compressor output line for passing compressed hot defrost gas to said main hot gas discharge line.

5. A refrigeration system according to claim 4 wherein the defrost hot gas supply line also supplies defrost hot gas to the main liquid line to flush out liquid refrigerant therefrom.

6. A refrigeration system according to claim 4 also including a vaporizer through which said defrost hot gas and said cooled defrost hot gas pass in heat exchange relationship.

7. A refrigeration system with hot gas defrost according to claim 4 including a system to handle liquid refrigerant resulting from condensing the hot gas defrost vapour in a coil or coils being defrosted, without affecting the normal operating pressures of the main compressor.

* * * * *